US008179407B2

(12) United States Patent
Ko et al.

(10) Patent No.: US 8,179,407 B2
(45) Date of Patent: May 15, 2012

(54) METHOD OF DRIVING A DISPLAY APPARATUS, AND DISPLAY APPARATUS AND TIMING CONTROLLER FOR PERFORMING THE METHOD

(75) Inventors: Hyun-Seok Ko, Seoul (KR); Sang-Gil Lee, Seoul (KR); Kyung Uk Choi, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 495 days.

(21) Appl. No.: 12/464,744

(22) Filed: May 12, 2009

(65) Prior Publication Data

US 2010/0060675 A1 Mar. 11, 2010

(30) Foreign Application Priority Data

Sep. 8, 2008 (KR) ..... 2008-88141

(51) Int. Cl.
*G09G 5/10* (2006.01)

(52) U.S. Cl. ..... 345/691; 345/89; 345/99

(58) Field of Classification Search ..... 345/87–102, 345/204–215, 690–691
See application file for complete search history.

(56) References Cited

U.S. PATENT DOCUMENTS

| | | | | |
|---|---|---|---|---|
| 7,522,143 | B2 * | 4/2009 | Park et al. | 345/98 |
| 2006/0007112 | A1 * | 1/2006 | Park | 345/102 |
| 2006/0164370 | A1 * | 7/2006 | Park et al. | 345/98 |
| 2008/0278432 | A1 * | 11/2008 | Ohshima | 345/102 |

FOREIGN PATENT DOCUMENTS

| | | |
|---|---|---|
| JP | 2006-259487 | 9/2006 |
| JP | 2006-330338 | 12/2006 |
| KR | 10-2004-0071507 | 8/2004 |

* cited by examiner

*Primary Examiner* — Vijay Shankar
(74) *Attorney, Agent, or Firm* — Innovation Counsel LLP

(57) ABSTRACT

A method of driving a display apparatus for an embodiment comprises a light source module divided into a plurality of light-emitting blocks to provide light to a display panel, a local dimming driving part driving the light-emitting blocks, and a timing controller controlling the driving timing of the display panel and the local dimming driving part. The timing controller transmits a luminance pulse having representative grayscale values of an image corresponding to the light-emitting blocks and a synchronization signal including information of a start position of the representative grayscale values to the local dimming driving part. The local dimming driving part drives the light-emitting blocks using the representative grayscale values obtained from the luminance pulse.

19 Claims, 8 Drawing Sheets

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | B19 | B20 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |
| B49 | B50 | B51 | B52 | B53 | B54 | B55 | B56 |
| B57 | B58 | B59 | B60 | B61 | B62 | B63 | B64 |

METHOD OF DRIVING A DISPLAY APPARATUS, AND DISPLAY APPARATUS AND TIMING CONTROLLER FOR PERFORMING THE METHOD

PRIORITY STATEMENT

This application claims priority under 35 U.S.C. §119 to Korean Patent Application No. 2008-88141, filed on Sep. 8, 2008 in the Korean Intellectual Property Office (KIPO), the contents of which are herein incorporated by reference in their entirety.

BACKGROUND

1. Technical Field

One or more embodiments of the present invention generally relate to a method of driving a display apparatus, and a display apparatus and a timing controller for performing the method. More particularly, one or more embodiments of the present invention relate to a method of driving a display apparatus having a plurality of light-emitting blocks so as to individually drive the plurality of light-emitting blocks, and a display apparatus and a timing controller for performing the method.

2. Description of the Related Art

Generally, a flat panel display apparatus such as a liquid crystal display (LCD) apparatus includes an LCD panel displaying an image using a light transmittance property of liquid crystal, and a backlight assembly disposed below the LCD panel to provide light to the LCD panel.

The LCD panel typically includes an array substrate having a plurality of pixel electrodes and a plurality of thin-film transistors (TFTs) electrically connected to the pixel electrodes, a color filter substrate having a common electrode and color filters, and a liquid crystal layer interposed between the array substrate and the color filter substrate.

The arrangement of the liquid crystal layer is changed by an electric field formed between the pixel electrodes and the common electrode, thereby changing the transmittance of light through the liquid crystal layer. Here, when the light transmittance is increased to a maximum, the LCD panel may display a white image with high luminance, and when the light transmittance is decreased to a minimum, the LCD panel may display a black image with low luminance.

However, as it is generally difficult for the liquid crystal layer to be perfectly arranged in a certain direction in the LCD panel, light leakage may be generated when the light transmittance is low such as an image with a low grayscale value. Therefore, it is difficult for the LCD panel to display a perfectly black image at the low grayscale value, thus decreasing the contrast ratio (CR) of an image displayed on the LCD panel.

Recently, a local dimming method has been developed that includes dividing a light source into a plurality of light-emitting blocks and controlling a luminance for each of the light-emitting blocks to drive the LCD panel, in order to prevent the CR of the image from decreasing and to minimize power consumption.

However, to control the luminance for each of the light-emitting blocks according to the image displayed on the LCD panel, information referring to the image signal displayed on the LCD panel and control signals for driving the light-emitting blocks to the backlight assembly have to be separately provided, increasing the manufacturing cost of the display apparatus.

SUMMARY

One or more embodiments of the present invention provide a method of driving a display apparatus for efficiently transmitting a driving signal for local dimming.

One or more embodiments of the present invention also provide a display apparatus for performing the above-mentioned method of driving a display apparatus.

One or more embodiments of the present invention also provide a timing controller for efficiently transmitting a driving signal for local dimming.

According to one or more embodiments of the present invention, there is provided a method of driving a display apparatus. The display apparatus includes a light source module divided into a plurality of light-emitting blocks to provide light to a display panel, a local dimming driving part driving the light-emitting blocks, and a timing controller controlling the driving timing of the display panel and the local dimming driving part. In the method, a luminance pulse is transmitted to the local dimming driving part. The luminance pulse has representative grayscale values of an image corresponding to the light-emitting blocks and a synchronization signal including information of a start position of the representative grayscale values. Then, the light-emitting blocks are driven using the representative grayscale values obtained from the luminance pulse in the local dimming driving part.

In accordance with an embodiment of the present invention, driving the light-emitting blocks may include detecting the synchronization signal from the luminance pulse; obtaining the representative grayscale values from the luminance pulse based on the synchronization signal; determining the dimming levels controlling the luminance of the light-emitting blocks using the representative grayscale values; and driving the light-emitting blocks using the dimming levels.

According to one or more embodiments of the present invention, a display apparatus includes a display panel, a light source module, a timing controller and a local dimming driving part. The display panel displays an image. The light source module provides light to the display panel. The light source module is divided into a plurality of light-emitting blocks. The timing controller outputs a luminance pulse having representative grayscale values of an image corresponding to the light-emitting blocks and a synchronization signal including information of a start position of the representative grayscale values to the local dimming driving part. The local dimming driving part drives the light-emitting blocks using the representative grayscale values obtained from the luminance pulse.

In accordance with an embodiment of the present invention, the timing controller includes a representative grayscale value obtaining part, a luminance pulse generating part, and an interface part. The representative grayscale value obtaining part obtains a red representative grayscale value, a green representative grayscale value, and a blue representative grayscale value from the image. The luminance pulse generating part generates red, green, and blue luminance pulses corresponding to the red, green, and blue representative grayscale values and inserts the synchronization signal to one of the red, green, and blue luminance pulses. The interface part transmits the red, green, and blue luminance pulses to the local dimming driving part.

In accordance with an embodiment of the present invention, the local dimming driving part includes an interface part, a data processing part, a representative luminance value calculating part, a dimming level determining part, and a light source driving part. The interface part receives the red, green, and blue luminance pulses. The data processing part obtains the red, green, and blue representative grayscale values from the red, green, and blue luminance pulses, respectively. The representative luminance value calculating part calculates representative luminance values of the light-emitting blocks using the red, green, and blue representative grayscale values. The dimming level determining part determines a dimming level for controlling the luminance of the light-emitting blocks based on the representative luminance values. The light source driving part drives the light-emitting blocks based on the dimming level.

According to one or more embodiments of the present invention, a timing controller includes a representative grayscale value obtaining part, a luminance pulse generating part, and an interface part. The representative grayscale value obtaining part obtains red, green, and blue representative grayscale values from an image received from an external device. The luminance pulse generating part generates red, green, and blue luminance pulses corresponding to the red, green, and blue representative values, respectively, and inserts a synchronization signal in one of the red, green, and blue luminance pulses. The interface part transmits the red, green, and blue luminance pulses to the external device.

According to one or more embodiments of the present invention, a timing controller includes a representative luminance value calculating part, a luminance pulse generating part, and an interface part. The representative luminance value calculating part calculates a representative luminance value using red, green, and blue representative grayscale values obtained from an image received from an external device. The luminance pulse generating part inserts a synchronization signal including information of a start position of the representative luminance value in a luminance pulse corresponding to the representative luminance value. The interface part transmits the luminance pulse to the external device.

According to one or more embodiments of the present invention of a method of driving a display apparatus and a display apparatus and a timing controller for performing the method, a luminance pulse having a representative grayscale value or having a representative luminance value of an image for local dimming and a synchronization signal are transmitted through one signal line. Thus, manufacturing costs of the display apparatus may be reduced since a signal line for transmitting the luminance pulse and a signal line for transmitting the synchronization signal are not differently constructed.

BRIEF DESCRIPTION OF THE DRAWINGS

The above and other embodiments of the present invention will be described in detail with reference to the accompanying drawings, in which.

DETAILED DESCRIPTION

Figure 1:
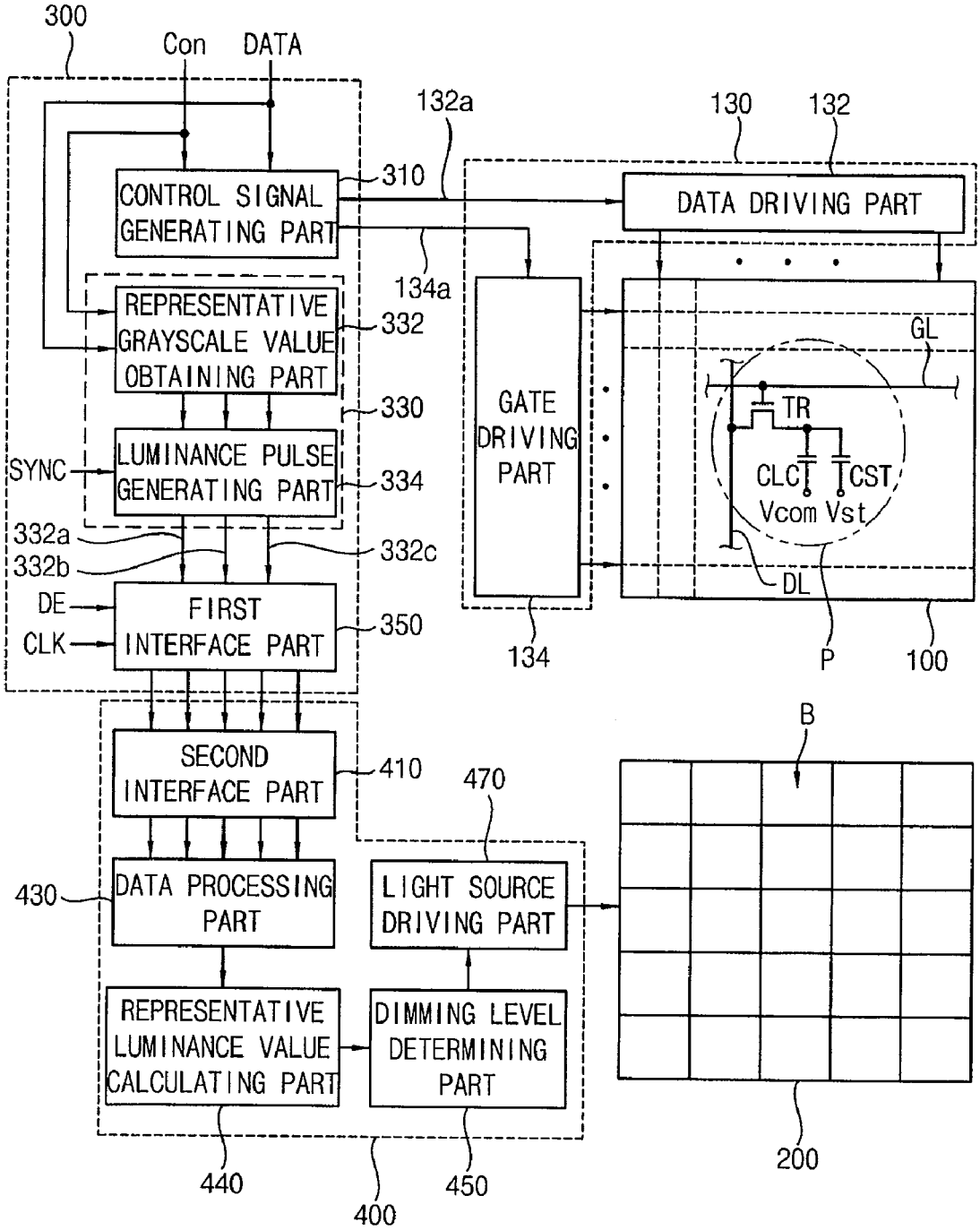
FIG. 1 is a block diagram illustrating a display apparatus according to a first embodiment of the present invention.

Embodiments in accordance with the present invention are described more fully hereinafter with reference to the accompanying drawings, in which one or more embodiments are shown. The present invention may, however, be embodied in many different forms and should not be construed as being limited to the embodiments set forth herein. In the drawings, the sizes and relative sizes of layers and regions may be exaggerated for clarity.

It will be understood that when an element or layer is referred to as being "on," "connected to" or "coupled to" another element or layer, it may be directly on, connected to or coupled to the other element or layer, or intervening elements or layers may be present. In contrast, when an element is referred to as being "directly on," "directly connected to" or "directly coupled to" another element or layer, there are no intervening elements or layers present. Like reference numerals refer to like elements throughout. As used herein, the term "and/or" includes any and all combinations of one or more of the associated listed items.

It will be further understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as being "below" or "beneath" other elements or features would then be oriented "above" the other elements or features. Thus, the exemplary term "below" or "beneath" may encompass both an orientation of above and below. The device may be otherwise oriented (rotated 90 degrees or at other orientations) and the spatially relative descriptors used herein may be interpreted accordingly.

The terminology used herein is for the purpose of describing particular embodiments of the present invention only and is not intended to be limiting of other embodiments of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the present invention are described herein with reference to cross-sectional illustrations that are schematic illustrations of idealized embodiments (and intermediate structures) of the present invention. As such, variations from the shapes of the illustrations as a result, for example, of manufacturing techniques and/or tolerances, are to be expected. Thus, embodiments of the present invention should not be construed as being limited to the particular shapes of regions illustrated herein but are to include deviations in shapes that may result, for example, from manufacturing. For example, an implanted region illustrated as a rectangle will, typically, have rounded or curved features and/or a gradient of implant concentration at its edges rather than a binary change from an implanted to a non-implanted region. Likewise, a buried region formed by implantation may result in some implantation in the region between the buried region and the surface through which the implantation takes place. Thus, the regions illustrated in the figures are schematic in nature, and their shapes are not intended to illustrate the actual shape of a region of a device and are not intended to limit the scope of the present invention.

Unless otherwise defined, all terms (including technical and scientific terms) used herein have the same meaning as they are commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be explained in detail with reference to the accompanying drawings.

First Embodiment

Figure 2:
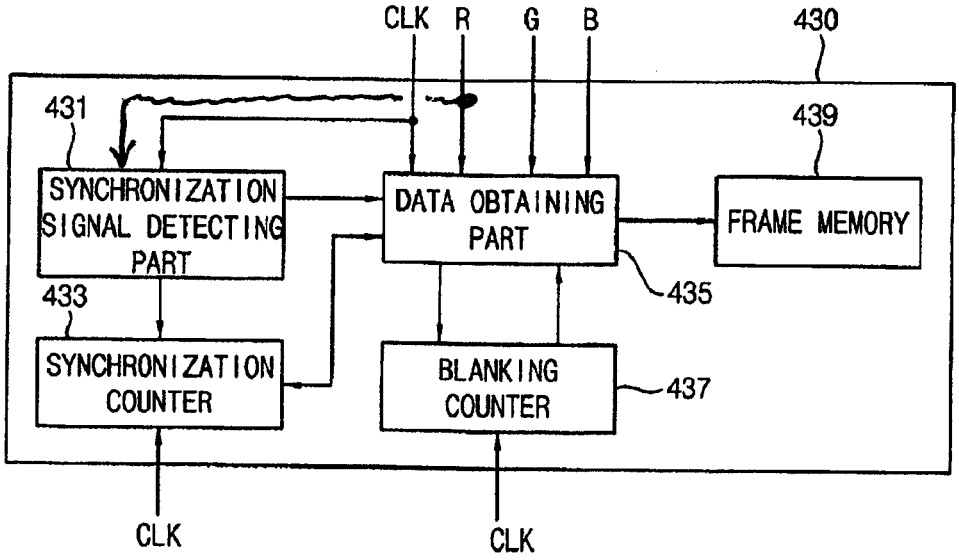
FIG. 2 is a block diagram illustrating in detail the data processing part of FIG. 1 according to one or more embodiments of the present invention.

FIG. 1 is a block diagram illustrating a display apparatus according to a first embodiment of the present invention. FIG. 2 is a block diagram illustrating in detail a data processing part of FIG. 1 according to one or more embodiments of the present invention.

Referring to FIGS. 1 and 2, a display apparatus includes a display panel 100, a panel driving part 130, a light source module 200, a timing controller 300, and a local dimming driving part 400.

The display panel 100 includes a plurality of pixels displaying an image. Each pixel P includes a switching element TR connected to a gate line GL and a data line DL, and a liquid crystal capacitor CLC and a storage capacitor CST that are connected to the switching element TR. The display panel 100 may be divided into a plurality of display blocks DB. The number of the display blocks DB may be m×n (wherein 'm' and 'n' are natural numbers).

The light source module 200 includes a printed circuit board (PCB) on which a plurality of light-emitting diodes (LEDs) are mounted. The light source module 200 includes the m×n light-emitting blocks B corresponding to the m×n display blocks DB. The light-emitting blocks B are disposed at positions corresponding to each of the display blocks DB. Each of the light-emitting blocks B includes a plurality of white LEDs.

The timing controller 300 includes a control signal generating part 310, a dimming signal processing part 330 and a first interface part 350.

The control signal generating part 310 receives a control signal Con and an image signal Data from an external device. The control signal Con may include a vertical synchronization signal, a horizontal synchronization signal and a clock signal. The timing controller 300 generates panel control signals 132*a* and 134*a* for controlling the driving timing of the panel driving part 130 using the control signal Con. Also, the timing controller 300 generates a dimming control signal for controlling the driving timing of the local dimming driving part 400 using the control signal Con. The dimming control signal may also be generated using a synchronization signal SYNC, a data enable signal DE and a clock signal CLK from the control signal generating part 310. The synchronization signal SYNC is received by the dimming signal processing part 330, and the data enable signal DE and the clock signal CLK are received by the first interface part 350.

The dimming signal processing part 330 includes a representative grayscale value obtaining part 332 and a luminance pulse generating part 334.

The representative grayscale value obtaining part 332 obtains red, green, and blue grayscale values (hereinafter referred to as "RGB representative grayscale values") of an image from each of the display blocks DB using the control signal Con and the image signal Data received from the external device. The RGB representative grayscale values may be any one of an average grayscale value, a maximum grayscale value, a minimum grayscale value or a practical effect value of the image signal Data displayed on each of the display blocks DB. The representative grayscale value obtaining part 332 outputs the representative grayscale values of each of the colors R, G, and B to the luminance pulse generating part 334 of the dimming signal processing part 330.

The luminance pulse generating part 334 receives the RGB representative grayscale values from the representative grayscale obtaining part 332 and also receives the synchronization signal SYNC from the control signal generating part 310. The synchronization signal SYNC is a signal indicating a start position of effective data. For example, the synchronization signal SYNC may be a horizontal synchronization signal indicating a start position of a line. The effective data whose start position is indicated by the SYNC is the RGB representative grayscale values.

The luminance pulse generating part 334 generates RGB luminance pulses corresponding to the RGB representative grayscale values. The luminance pulse generating part 334 inserts the synchronization signal SYNC into one of the RGB luminance pulses. For the two other luminance pulses in which the synchronization signal SYNC is not inserted, the luminance pulse generating part 334 inserts ineffective data into an interval corresponding to an interval in which the synchronization signal SYNC is inserted. For example, when the synchronization signal SYNC is inserted and output in the R-luminance pulse, the G-luminance pulse and the B-luminance pulse may input and output ineffective data in an interval corresponding to an interval in which the synchronization signal SYNC is inserted.

The first interface part 350 receives the RGB representative grayscale values 332*a*, 332*b*, and 332*c* transmitted as effective data in the RGB luminance pulses from the luminance pulse generating part 334 and also receives the data enable signal DE and the clock signal CLK from the control signal generating part 310.

The first interface part 350 may provide a first signal line transmitting the R-luminance pulse, a second signal line transmitting the G-luminance pulse, a third signal line transmitting the B-luminance pulse, a fourth signal line transmitting the data enable signal DE, and a fifth signal line transmitting the clock signal CLK. The data enable signal DE is a signal indicating a start position of one frame.

The panel driving part 130 drives the display panel 100 using the panel control signals 132*a*, 134*b* provided from the control signal generating part 310.

The panel driving part 130 may include a data driving part 132 and a gate driving part 134. The panel control signal 132*a*, 134*a* include a first control signal 132*a* for controlling the driving timing of the data driving part 132 and a second control signal 134*a* for controlling the driving timing of the gate driving part 134. The first control signal 132*a* may include a clock signal and a horizontal start signal, and the second control signal 134*a* may include a vertical start signal.

The data driving part 132 generates data signals using the first control signal 132*a* and the data image signal Data and provides the generated data signals to the data line DL.

The gate driving part 134 generates gate signals for activating the gate line GL using the second control signal 134*a* and provides the generated gate signals to the gate line GL.

The local dimming driving part 400 includes a second interface part 410, a data processing part 430, a representative luminance value calculating part 440, a dimming level determining part 450 and a light source driving part 470.

The second interface part 410 performs data communication with the first interface part 350. The second interface part 410 may include a first signal line receiving the R-luminance pulse, a second signal line receiving the G-luminance pulse, a third signal line receiving the B-luminance pulse, a fourth signal line receiving the data enable signal DE, and a fifth signal line receiving the clock signal CLK.

The second interface part 410 outputs the RGB luminance pulses, the data enable signal DE, and the clock signal CLK, received through the first signal line to the fifth signal line, to the data processing part 430.

The data processing part 430 detects the synchronization signal SYNC inserted in any one of the R-, G-, and B-luminance pulses R, G, and B and obtains the RGB representative grayscale values which are effective data from the R-, G-, and B-luminance pulses R, G, and B based on the detected synchronization signal SYNC. Hereinafter, an example will be described in which the synchronization signal SYNC is included in the R-luminance pulse.

As shown in FIG. 2, the data processing part 430 includes a synchronization signal detecting part 431, a synchronization counter 433, a data obtaining part 435, a blanking counter 437, and a frame memory 439.

The synchronization signal detecting part 431 receives the clock signal CLK and the R-luminance pulse R comprising the synchronization signal SYNC and the R-representative grayscale value 332*a*. The synchronization signal detecting part 431 detects the synchronization signal SYNC from the R-luminance pulse R based on the clock signal CLK.

Figure 3:
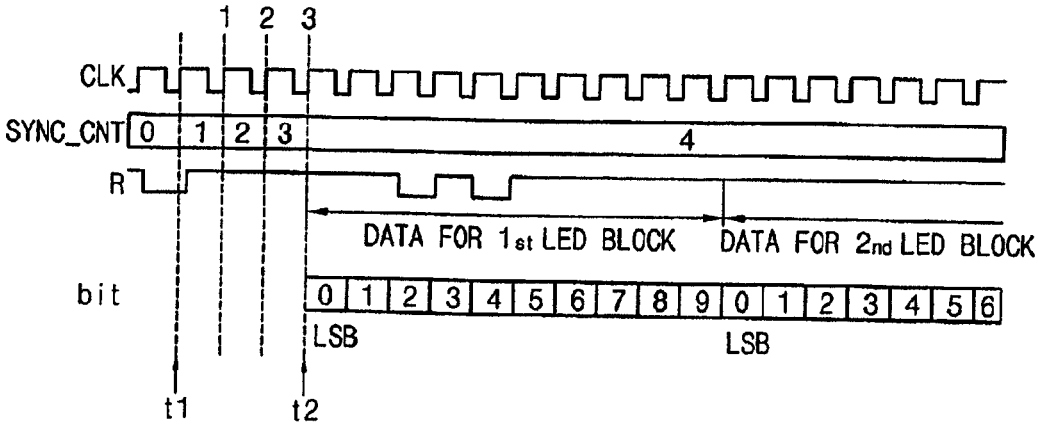
FIG. 3 is a waveform diagram illustrating an operation of a synchronization signal detecting part of FIG. 2 according to one or more embodiments of the present invention.

FIG. 3 is a waveform diagram illustrating an operation of a synchronization signal detecting part of FIG. 2 according to one or more embodiments of the present invention.

Referring to FIGS. 2 and 3, the synchronization signal detecting part 431 detects a first time change in a level of the R-luminance pulse R during an interval as the synchronization signal SYNC. For example, the synchronization signal detecting part 431 detects a first time change from a high level to a low level in the R-luminance pulse R during an interval as the synchronization signal SYNC. When a rising edge of the clock signal CLK is detected in a state in which the R-luminance pulse R has been changed to the low level, the synchronization signal detecting part 431 transmits a signal to indicate to the data obtaining part 435 that the synchronization signal SYNC is detected.

In one or more embodiments, the interval for the synchronization signal detecting part 431 to detect a first time change in the level of the R-luminance pulse R is after a preset blanking interval or after the data enable signal DE is received. The synchronization signal SYNC may include a vertical synchronization signal and a horizontal synchronization signal. Also, the data enable signal DE may be transmitted during the blanking interval.

Also, the synchronization signal detecting part 431 transmits a counting start signal to the synchronization counter 433 when the synchronization signal SYNC is detected. For example, when the synchronization signal SYNC is detected at time t1, the counting start signal is output to the synchronization counter 433 as well as a signal indicating that the synchronization signal SYNC is detected is output to the data obtaining part 435 at time t1.

The synchronization counter 433 receives the clock signal CLK. The synchronization counter 433 counts the number of the rising edges of the clock signal CLK in response to the counting start signal from the synchronization signal detecting part 431. The synchronization counter 433 increases a counting value by one every time the rising edge of the clock signal CLK is detected. The synchronization counter 433 outputs the counting value to the data obtaining part 435.

The synchronization counter 433 maintains the present counting value (for example, 4) until a reset signal is received, without further increasing the counting value when the counting value reaches a preset value (for example, 4).

The data obtaining part 435 receives the counting value from the synchronization counter 433. The data obtaining part 435 determines that the R-representative grayscale value is received when the counting value of the synchronization counter 433 reaches a first setting value (for example, 3) that has been preset. The data obtaining part 435 analyzes the R-luminance pulse R that has been synchronized with the clock signal CLK to obtain the R-representative grayscale value.

Also, the data obtaining part 435 obtains the G-representative grayscale value and the B-representative grayscale value in the G-luminance pulse G and the B-luminance pulse B which include the ineffective data, respectively, to output the G-representative grayscale value and the B-representative grayscale value to the frame memory 439.

The data obtaining part 435 recognizes that the RGB representative grayscale values 332*a*, 332*b*, and 332*c* applicable to a first light-emitting block of the light source module 200 are received inside one driving block when the counting value of the synchronization counter 433 reaches the first setting value. For example, the R-representative grayscale value 332*a* corresponding to the first light-emitting block is received from time t2 of FIG. 3. Although not shown in FIG. 3, the G-representative grayscale value 332*b* and the B-representative grayscale value 332*c* are also received at time t2.

Figures 4, 5:
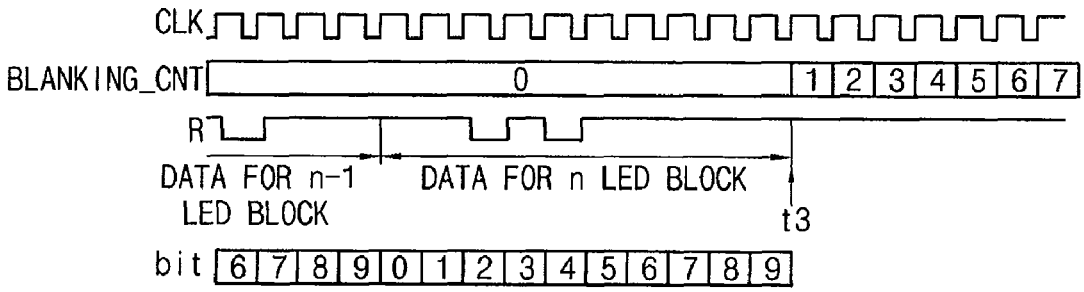
FIG. 4 is a plan view illustrating the light source module of FIG. 1 according to one or more embodiments of the present invention.
FIG. 5 is a waveform diagram illustrating an operation of a blanking counter of FIG. 2 according to one or more embodiments of the present invention.

According to one or more embodiments of the present invention, when the light source module 200 is divided into 8×8 light-emitting blocks B1 to B64, the light-emitting blocks may be grouped into eight driving blocks, with each driving block consisting of eight consecutive light-emitting blocks, as shown in FIG. 4. For example, a first light-emitting block to an eighth light-emitting block B1 to B8 are grouped into a first driving block, a ninth light-emitting block to a 16th light-emitting block B9 to B16 are grouped into a second driving block, a 17th light-emitting block to a 24th light-emitting block B17 to B24 are grouped into a third driving block, a 25th light-emitting block to a 32nd light-emitting block B25 to B32 are grouped into a fourth driving block, a 33rd light-emitting block to a 40th light-emitting block B33 to B40 are grouped into a fifth driving block, a 41st light-emitting block to a 48th light-emitting block B41 to B48 are grouped into a sixth driving block, a 49th light-emitting block to a 56th light-emitting block B49 to B56 are grouped into a seventh driving block and a 57th light-emitting block to a 64th light-emitting block B57 to B64 are grouped into an eighth driving block. The light source module 200 may be driven by the driving block unit. In the above example, the first light-emitting block of the first driving block to the eighth driving block may then be light-emitting block B1, B9, B17, B25, B33, B41, B49, and B57, respectively.

The data processing part 430 further includes a blanking counter 437 for counting a blanking interval in which the effective data is not transmitted. The data obtaining part 435 outputs a counting start signal to the blanking counter 437 when the RGB representative grayscale values corresponding to one driving block have been obtained. The blanking counter 437 receives the clock signal CLK and counts the rising edge of the clock signal CLK in response to the counting start signal from the data obtaining part 435. The blanking counter 437 outputs the counting value to the data obtaining part 435.

FIG. 5 is a waveform diagram illustrating an operation of a blanking counter of FIG. 2 according to one or more embodiments of the present invention.

As shown in FIG. 5, the data obtaining part 435 outputs the counting start signal to the blanking counter 437 at time t3 when the R-representative grayscale value corresponding to a last light-emitting block (n LED block) of a driving block has been obtained. For example, time t3 may be when the R-representative grayscale value corresponding to the last light-emitting block B8 of the first driving block has been obtained. At time t3, the blanking counter 437 increases the counting value by one every time the rising edge of the clock signal CLK is detected.

The data obtaining part 435 compares the counting value received from the blanking counter 437 with a second setting value (for example, 300) that has been preset to determine the end of the blanking interval. The data obtaining part 435 treats a luminance pulse received in the blanking interval as the ineffective data.

Also, the data obtaining part 435 determines that effective data corresponding to a new driving block is received when the counting value of the blanking counter 437 reaches the second setting value. After the blanking interval and as described earlier, the synchronization signal detecting part 431 recognizes a first time change from a high level to a low level in the R-luminance pulse R received as the synchronization signal SYNC.

The data obtaining part 435 outputs a reset signal to the synchronization counter 433 and the blanking counter 437 when the counting value of the blanking counter 437 reaches the second setting value. In one or more embodiments of the present invention, the counting values of the synchronization counter 433 and the blanking counter 437 are reset every ⅛ of a frame.

As described above, erroneously mistaking the synchronization signal SYNC as the effective data or the effective data as the synchronization signal SYNC may be prevented by detecting for a blanking interval in which the effective data is not transmitted.

The frame memory 439 stores and outputs the RGB representative grayscale values received from the data obtaining part 435 to the representative luminance value calculating part 440 by a certain unit (e.g. data size). For example, the frame memory 439 may output the RGB representative grayscale values to the representative luminance value calculating part 440 by the driving block unit or by one frame.

The representative luminance value calculating part 440 obtains a representative luminance value of each light-emitting block using each of the RGB representative grayscale values received from the frame memory 439. For example, the representative luminance value calculating part 440 may calculate the representative luminance value through a sRGB-to-YCbCr conversion matrix.

The dimming level determining part 450 determines a dimming level for controlling the brightness of each of the light-emitting blocks using the representative luminance value received from the representative luminance value calculating part 440. For example, the dimming level determining part 450 increases the dimming level when the representative luminance value is high and decreases the dimming level when the representative luminance value is small. The dimming level determining part 450 determines dimming levels corresponding to the light-emitting blocks to output the levels to the light source driving part 470.

The light source driving part 470 generates driving signals for driving the light-emitting blocks of the light source module 200 using the dimming levels received from the dimming level determining part 450. The driving signals may be PWM (pulse-width modulated) signals. The light source driving part 470 may drive the light-emitting blocks individually or by a certain unit (e.g., a certain block size) using the driving signals. For example, the light source driving part 470 may drive the light-emitting blocks by a 1 unit (e.g., one light-emitting block) such that the driving signals correspond to each of the light-emitting blocks. The light-emitting blocks are thus driven to a brightness corresponding to the luminance of an image signal displayed on the display blocks DB of the display panel 100 corresponding to the light-emitting block.

Figure 6A:
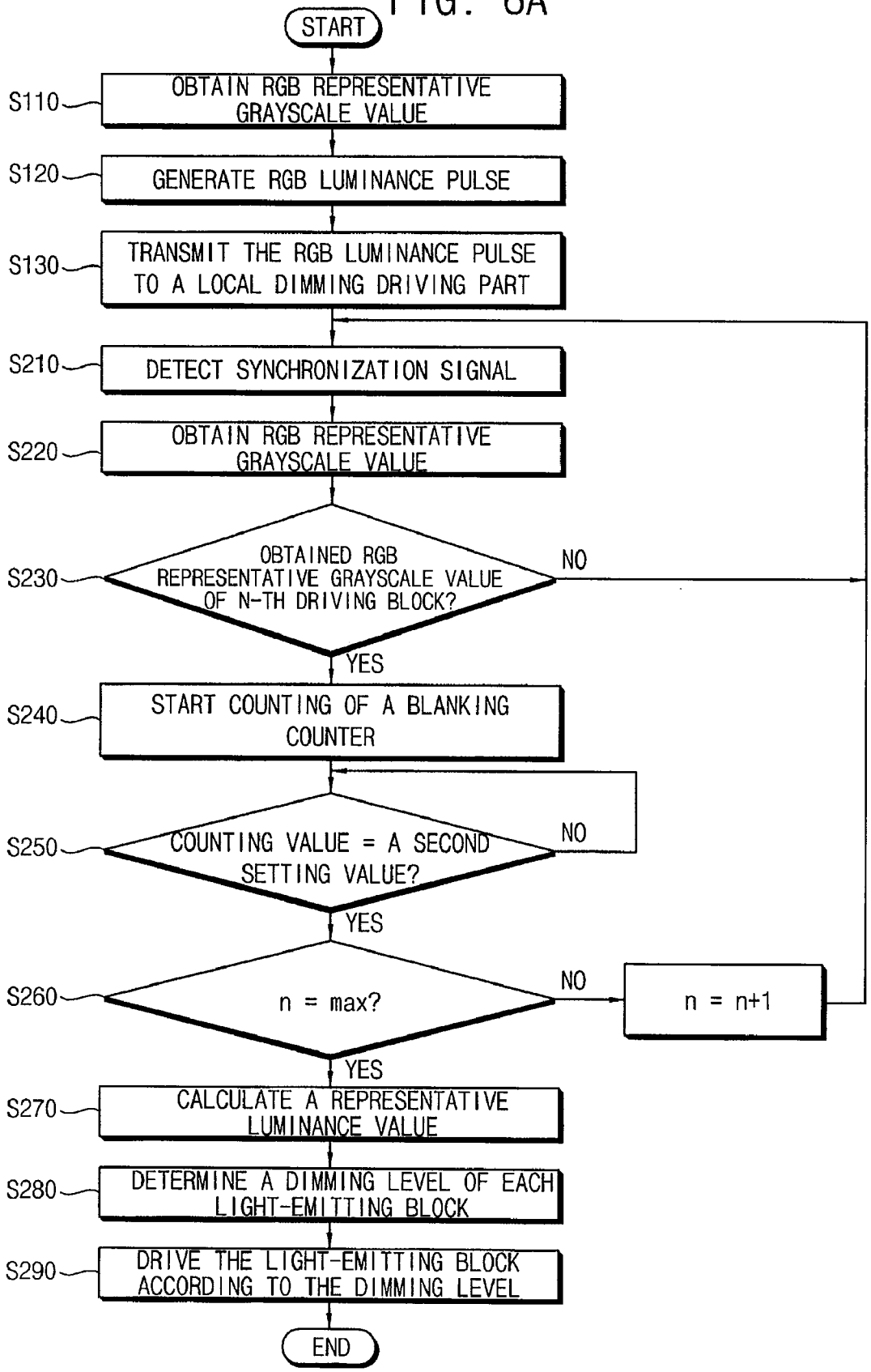
FIGS. 6A and 6B are flowcharts illustrating a method of driving a display apparatus of FIG. 1 according to one or more embodiments of the present invention.
Figure 6B:
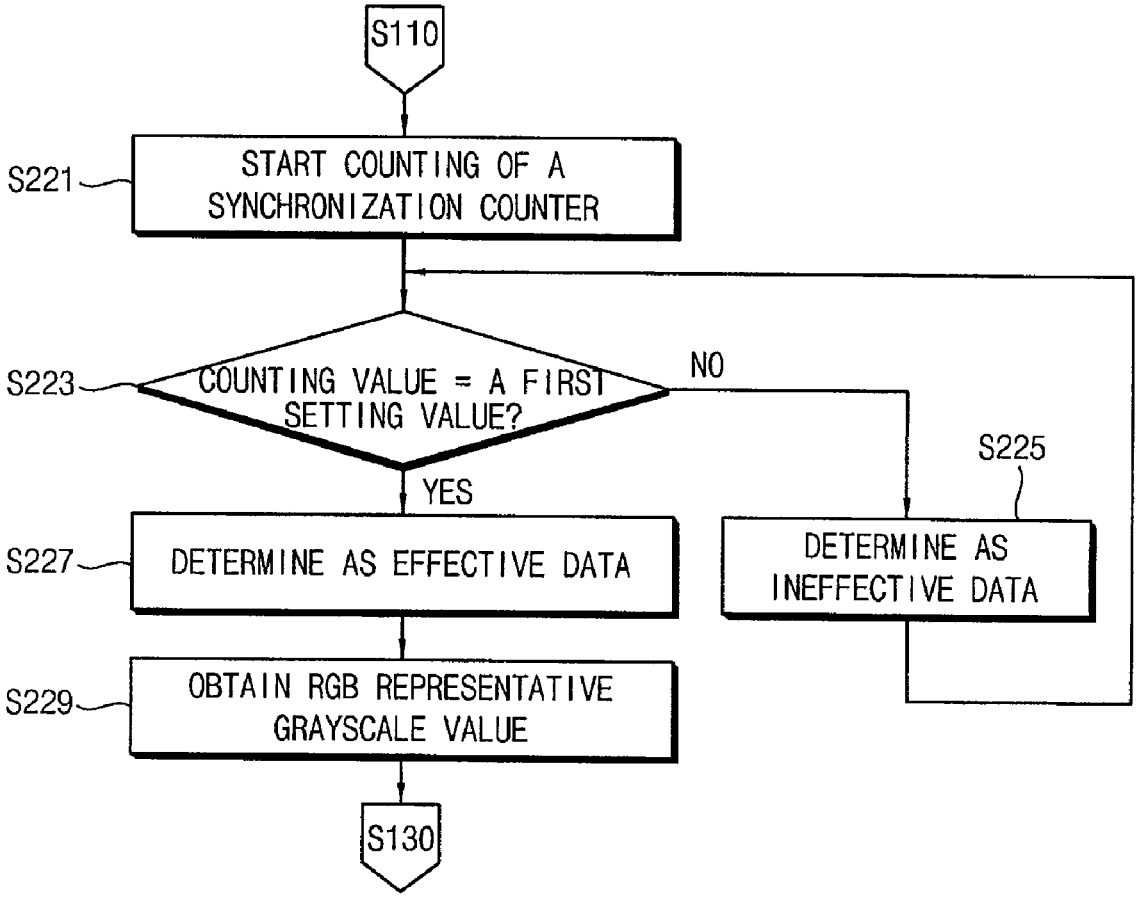

FIGS. 6A and 6B are flowcharts illustrating a method of driving a display apparatus of FIG. 1 according to one or more embodiments of the present invention.

Referring to FIGS. 1, 2 and 6A, the representative grayscale value obtaining part 332 obtains the RGB representative grayscale values of an image from each of the display blocks DB corresponding to the light-emitting blocks (step S110).

The luminance pulse generating part 334 generates the RGB luminance pulses corresponding to the RGB representative grayscale values, and inserts the synchronization signal SYNC in any one of the RGB luminance pulses (step S120). Hereinafter, an example will be described in which the synchronization signal SYNC is included in the R-luminance pulse.

The first interface part 350 receives the RGB luminance pulses from the luminance pulse generating part 334 and transmits the RGB luminance pulses to the local dimming driving part 400 (step S130). The second interface part 410 of the local dimming driving part 400 receives the RGB luminance pulses from the first interface part 350 for processing by the data processing part 430.

In the data processing part 430, the synchronization signal detecting part 431 detects the synchronization signal SYNC from the R-luminance pulse received from the second interface part 410 (step S210).

The synchronization signal detecting part 431 transmits the counting start signal to the synchronization counter 433 while transmitting a signal to indicate to the data obtaining part 435 that the synchronization signal SYNC is detected when the synchronization signal SYNC is detected.

The data obtaining part 435 obtains the RGB representative grayscale values from the RGB luminance pulses based on the synchronization signal SYNC detected in step S210 (step S220).

Referring to FIG. 6B to explain step S220, the synchronization counter 433 counts a number of the rising edges of the clock signals CLK in response to the counting start signal (step S221). The counting value of the synchronization counter 433 is output to the data obtaining part 435.

The data obtaining part 435 checks whether or not the counting value of the synchronization counter 433 reaches a first setting value (for example, 3) (step S223).

In step S223, when the counting value of the synchronization counter 433 is smaller than the first setting value, the data obtaining part 435 determines the RGB luminance pulses synchronized to the clock signal CLK as the ineffective data (step S225) and the process is fed back to step S223 to check for the next increment of the counting value.

Alternatively, in step S223, when the counting value of the synchronization counter 433 is equal to the first setting value, the data obtaining part 435 determines the RGB luminance pulses synchronized to the clock signal CLK as the effective data (step S227).

The data obtaining part 435 analyzes the RGB luminance pulses determined as the effective data to obtain each of the RGB representative grayscale values (step S229). The RGB representative grayscale values temporarily are stored in the frame memory 439.

Referring back to FIG. 6A, the data obtaining part 435 checks whether or not the RGB representative grayscale values obtained correspond to the last light-emitting block of the n-th driving block (step S230).

In step S230, when it is determined that the RGB representative grayscale values corresponding to the last light-emitting block of the n-th driving block have not yet been obtained, the data obtaining part 435 is fed back to step S210 to continue the operation to detect the next synchronization signal and to obtain the RGB representative grayscale value in the RGB luminance pulses.

Alternatively, in step S230, when it is determined that the RGB representative grayscale values corresponding to the last light-emitting block of the n-th driving block have been received, the data obtaining part 435 outputs the counting start signal to the blanking counter 437.

The blanking counter 437 counts the rising edge of the clock signal CLK in response to the counting start signal (step S240). The blanking counter 437 outputs the counting value to the data obtaining part 435.

The data obtaining part 435 checks whether or not the counting value of the blanking counter 437 reaches the second setting value (step S250).

In step S250, when the counting value of the blanking counter 437 is smaller than the second setting value, the data obtaining part 435 is fed back to step S250 to check for the next increment of the counting value.

Alternatively, in step S250, when the counting value of the blanking counter 437 is equal to the second setting value, the data obtaining part 435 checks whether or not the n-th driving block is a last driving block of the light source module 200 (step S260). For example, when the light source module 200 is comprised of the 8 driving blocks as shown in FIG. 4, the last driving block becomes the eighth driving block.

In step S260, when it is determined that the n-th driving block is not the last driving block, the data obtaining part 435 is fed back to step S210 to repeatedly perform the operations of step S210 to step S250.

In step S260, when it is determined that the n-th driving block is the last driving block, the representative luminance value calculating part 440 calculates representative luminance values corresponding to each of the light-emitting blocks using the RGB representative grayscale values (step S270).

The dimming level determining part 450 determines a dimming level for controlling the brightness of each of the light-emitting blocks using the representative luminance values received from the representative luminance value calculating part 440 (step S280). For example, when the representative luminance value is high, the dimming level determining part 450 may increase the dimming level, and when the representative luminance value is small, the dimming level determining part 450 may decrease the dimming level. The dimming level determining part 450 outputs the dimming level information to the light source driving part 470.

The light source driving part 470 generates driving signals for driving the light-emitting blocks of the light source module 200 using the dimming levels received from the dimming level determining part 450 and drives the light-emitting blocks using the generated driving signals (step S290).

In the present embodiment, the light source module 200 may comprise the white LEDs, but it is not limited thereto. That is, the light source module 200 may include red, green, and blue LEDs in one or more embodiments of the present invention. In this case, the representative luminance value calculating part 440 may be omitted. That is, the dimming level determining part 450 may determine the dimming level for each of the RGB of the light-emitting blocks using the RGB representative grayscale value.

Second Embodiment

Figure 7:
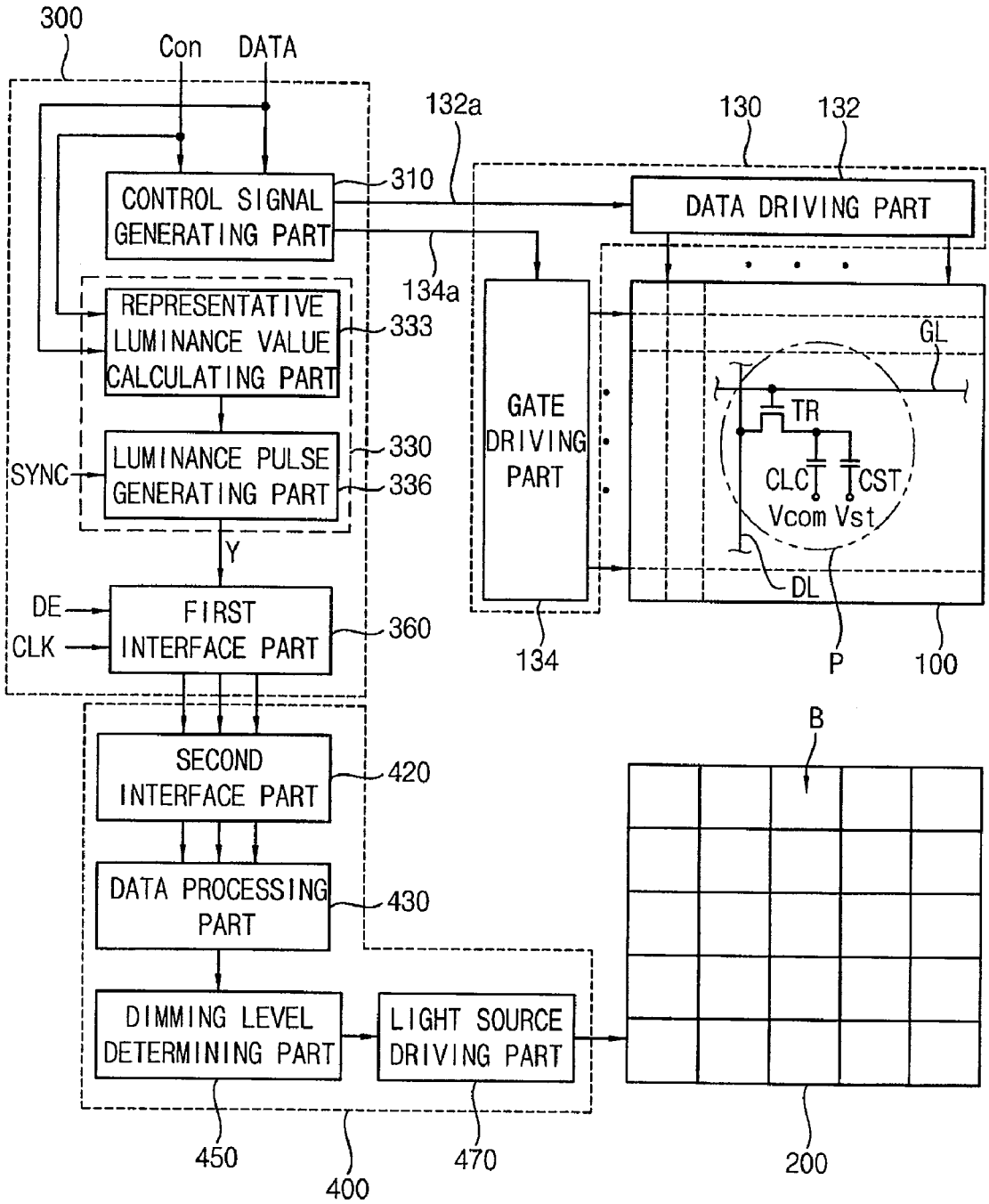
FIG. 7 is a block diagram illustrating a display apparatus according to a second embodiment of the present invention.
Figure 8:
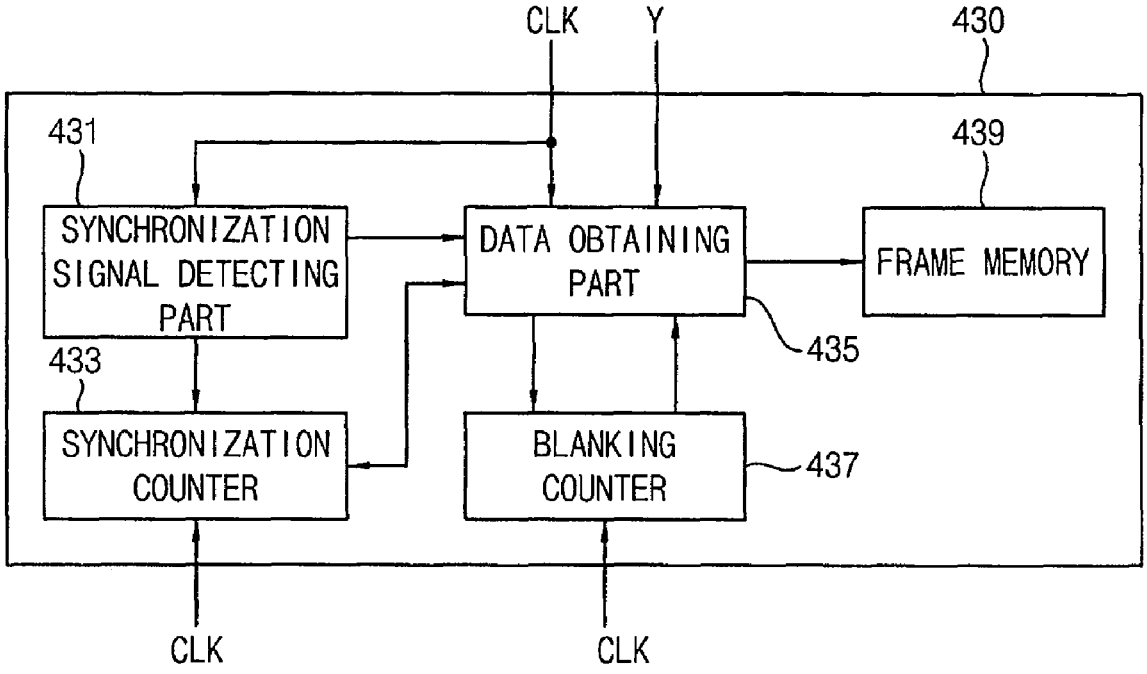
FIG. 8 is a block diagram illustrating in detail the data processing part of FIG. 7 according to one or more embodiments of the present invention.

FIG. 7 is a block diagram illustrating a display apparatus according to a second embodiment of the present invention. FIG. 8 is a block diagram illustrating in detail the data processing part of FIG. 7 according to one or more embodiments of the present invention.

Since a display apparatus according to the present embodiment is substantially the same as the display apparatus according to the first embodiment of FIG. 1, except that the composition of the dimming signal processing part 330 is changed and the representative luminance value calculating part 440 of the first embodiment is omitted in the local dimming driving part 400 of the present embodiment, the same elements are illustrated using the same reference numbers and any repetitive detailed explanations will be omitted.

Referring to FIGS. 7 and 8, a display apparatus includes a display panel 100, a panel driving part 130, a light source module 200, a timing controller 300, and a local dimming driving part 400.

The timing controller 300 includes a control signal generating part 310, a dimming signal processing part 330, and a first interface part 360.

The dimming signal processing part 330 includes a representative luminance value calculating part 333 and a luminance pulse generating part 336.

The representative luminance value calculating part 333 obtains representative luminance values of display blocks DB of the display panel 100 using a control signal Con and an image signal Data received from an external device. That is, the representative luminance value calculating part 333 may obtain RGB representative grayscale values from the display blocks DB and may calculate the representative luminance value using the obtained RGB representative grayscale values. For example, the representative luminance value calculating part 333 may calculate the representative luminance value through a sRGB-to-YCbCr conversion matrix.

The luminance pulse generating part 336 generates a representative luminance pulse Y comprising the representative luminance value received from the representative luminance value calculating part 333. The luminance pulse generating part 336 inserts a synchronization signal SYNC received from the control signal generating part 310 to the representative luminance pulse Y.

The first interface part 360 may output a first signal line transmitting the representative luminance pulse Y comprising the synchronization signal SYNC, a second signal line transmitting a data enable signal DE, and a third signal line transmitting a clock signal CLK.

The local dimming driving part 400 includes a second interface part 420, a data processing part 430, a dimming level determining part 450, and a light source driving part 470.

The second interface part 420 performs data communication with the first interface part 360. The second interface part 420 may include a first signal line receiving the representative luminance pulse Y, a second signal line receiving the data enable signal DE, and a third signal line receiving the clock signal CLK.

The data processing part 430 detects the synchronization signal SYNC from the representative luminance pulse Y and obtains the representative luminance value from the representative luminance pulse Y based on the detected synchronization signal SYNC.

The data processing part 430, as illustrated in detail in FIG. 8, may include a synchronization signal detecting part 431, a synchronization counter 433, a data obtaining part 435, a frame memory 439, and a blanking counter 437. The synchronization signal detecting operation is substantially the same as the synchronization signal detecting operation illustrated through FIG. 3 except for the type of signal received from the data obtaining part 435, and thus any further detailed explanations concerning the same elements will be omitted. Also, the representative luminance value obtaining operation of the present embodiment is substantially the same as the RGB representative grayscale value obtaining operation of the first embodiment, and thus any further detailed explanations concerning the same will be omitted.

The dimming level determining part 450 determines a dimming level for controlling the brightness of each light-emitting block using the representative luminance value received from the data processing part 430. The dimming level determining part 450 determines the dimming levels corresponding to the light blocks for output to the light source driving part 470.

The light source driving part 470 generates driving signals for driving the light-emitting blocks of the light source module 200 using the dimming levels received from the dimming level determining part 450. The driving signals may be PWM (pulse-width modulated) signals.

Figure 9:
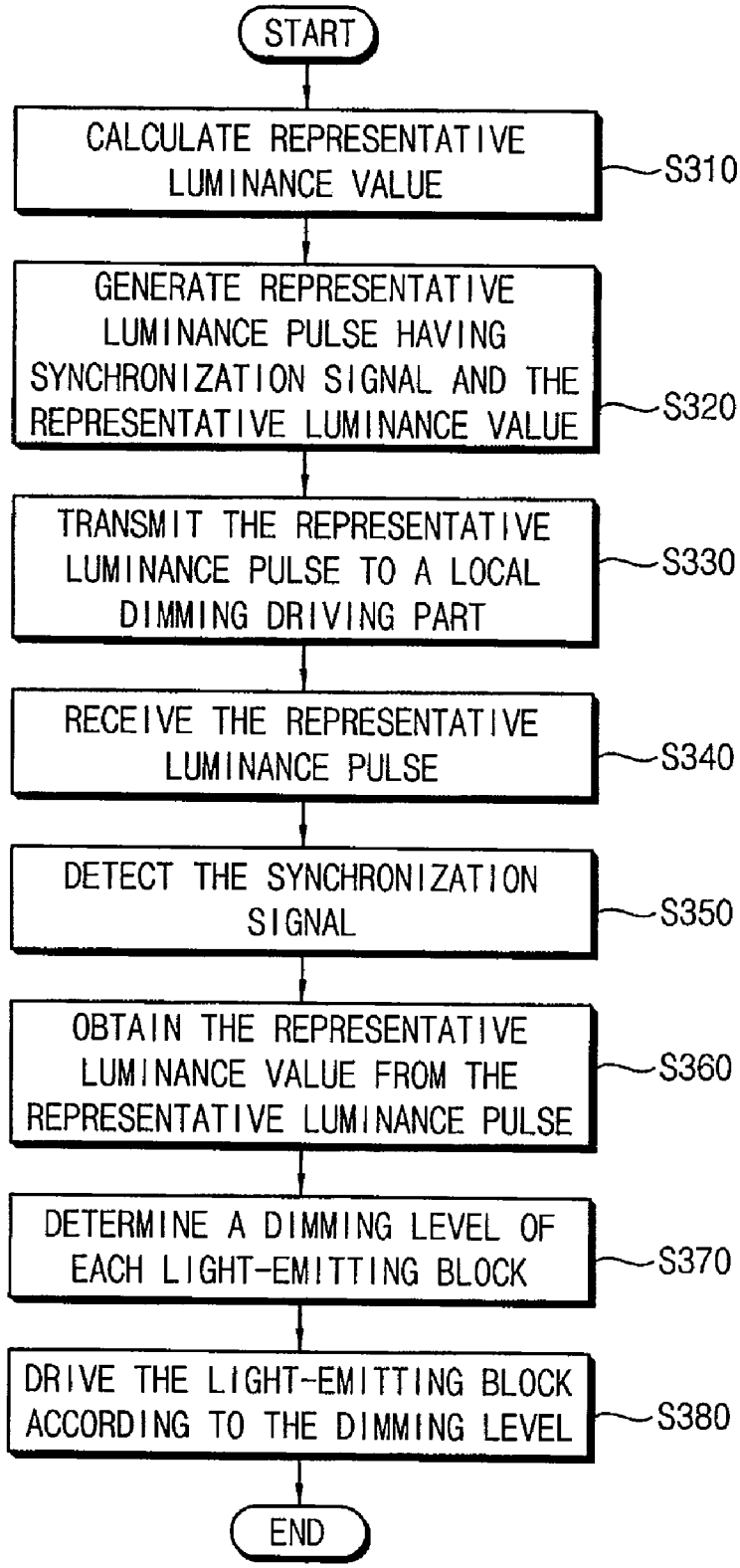
FIG. 9 is a flowchart illustrating a method of driving a display apparatus of FIG. 7 according to one or more embodiments of the present invention.

FIG. 9 is a flowchart illustrating a method of driving a display apparatus of FIG. 7 according to one or more embodiments of the present invention.

Referring to FIGS. 7, 8 and 9, the representative luminance value calculating part 333 calculates representative luminance values of the display blocks DB using the control signal Con and the image signal Data received from the external device (step S310).

When generating the representative luminance pulse Y corresponding to the representative luminance value received from the representative luminance calculating part 333, the luminance pulse generating part 336 inserts the synchronization signal SYNC to an interval in front of an interval corresponding to the representative luminance value (step S320).

The first interface part 360 transmits the representative luminance pulse Y received from the luminance pulse generating part 336, the data enable signal DE, and the clock signal CLK to the second interface part 420 (step S330).

The second interface part 420 receives the representative luminance pulse Y, the data enable signal DE, and the clock signal CLK from the first interface part 260 (step S340).

The data processing part 430 detects the synchronization signal SYNC from the representative luminance pulse Y received through the second interface part 420 (step S350), and obtains the representative luminance value from the representative luminance pulse Y using the detected synchronization signal SYNC (step S360).

The dimming level determining part 450 determines a dimming level of the light-emitting block using the representative luminance value received form the data processing part 430 (step S370).

The light source driving part 470 drives the light-emitting blocks of the light source module 200 according to the dimming level received from the dimming level determining part 450 (step S380).

As described above, according to one or more embodiments of the present invention, manufacturing costs may be reduced since a signal line for transmitting the luminance pulse and a signal line for transmitting the synchronization signal may not need to be separately constructed. That is, manufacturing costs may be reduced by including the synchronization signal in a luminance pulse having representative grayscale values or representative luminance values required for determining a dimming level of the light-emitting blocks.

Also, errors in mistaking the synchronization signal for the effective data or in mistaking the effective data for the synchronization signal may be prevented by checking for the blanking interval in which effective data is not included.

The foregoing embodiments are illustrative of the present invention and are not to be construed as limiting thereof. Although one or more embodiments have been described, those skilled in the art will readily appreciate in light of the foregoing that many modifications in form and detail to the embodiments are possible without materially departing from the spirit and scope of the present disclosure of invention. Accordingly, all such modifications are intended to be included within the scope of the present teachings.

What is claimed is:

1. A method of driving a display apparatus comprising a light source module divided into a plurality of individually controlled light-emitting blocks to thereby provide individually controlled blocks of illuminating light to a display panel, the display apparatus further comprising a local dimming driving part configured for driving the light-emitting blocks, and a timing controller configured for controlling a driving timing of the display panel and of the local dimming driving part, the method comprising:

transmitting a luminance pulse signal in combination with a synchronization signal to the local dimming driving part, the luminance pulse signal having embedded therein representative grayscale values representative of luminances of respective image data portions corresponding to the respective light-emitting blocks, and the synchronization signal being indicative of a temporal start position of the transmitted representative grayscale values, the synchronization signal being transmitted to the local dimming driving part along with the representative grayscale values; and driving the light-emitting blocks using the representative grayscale values obtained from the luminance pulse that has been transmitted to the local dimming driving part along with the synchronization signal.

2. The method of claim 1, wherein the synchronization signal is embedded in the transmission of the luminance pulse signal and wherein the driving of the light-emitting blocks further comprises:

detecting a presence of the synchronization signal within the transmission of the luminance pulse signal;

obtaining the representative grayscale values from the luminance pulse signal based on the temporal start position indicated by the detected synchronization signal;

determining dimming levels controlling the luminance of the light-emitting blocks using the representative grayscale values; and driving the light-emitting blocks using the dimming levels.

3. The method of claim 2, wherein the obtaining the representative grayscale values comprises:

counting a number of edges of a clock signal transmitted from the timing controller to generate a counted value in response to the detection of the synchronization signal; and obtaining the representative grayscale values by analyzing the luminance pulse signal after the counted value becomes a first setting value that has been preset.

4. The method of claim 3, wherein the light-emitting blocks are grouped into a plurality of driving blocks, the method further comprising:

determining a blanking interval by counting a number of edges of the clock signal from a point in time when the representative grayscale values corresponding to one driving block have been obtained.

5. The method of claim 4, wherein the detecting the synchronization signal comprises detecting a first time change in a level of the luminance pulse signal after occurrence of a blanking interval.

6. The method of claim 2, wherein the representative grayscale values comprise a red representative grayscale value, a green representative grayscale value, and a blue representative grayscale value.

7. The method of claim 6, wherein determining the dimming levels comprises:

calculating representative luminance values based on the red, green and blue representative grayscale values; and determining dimming levels of the light-emitting blocks using the representative luminance values.

8. A timing controller comprising:

a representative grayscale value obtaining part adapted to obtain red, green and blue representative grayscale values from an image received from an external device;

a luminance pulse generating part adapted to generate red, green and blue luminance pulse signals corresponding to the red, green and blue representative grayscale values, respectively, and further adapted to insert a synchronization signal into one of the red, green and blue luminance pulse signals; and an interface part adapted to transmit the red, green, and blue luminance pulse signals to the external device.

9. A timing controller comprising:

a representative luminance value calculating part adapted to calculate representative luminance values using red, green and blue representative grayscale values obtained from an image received from an external device;

a luminance pulse generating part adapted to insert a synchronization signal that indicates a temporal start position of the representative luminance values within a transmitted luminance pulse signal corresponding to the representative luminance values; and an interface part adapted to transmit the luminance pulse signal to the external device.

10. A display apparatus comprising:

a display panel adapted to display an image;

a light source module adapted to provide light to the display panel, the light source module being divided into a plurality of individually controlled light-emitting blocks;

a timing controller adapted to output a luminance pulse signal having representative grayscale values of the image embedded in the luminance pulse signal, the representative grayscale values corresponding to luminance settings for the light-emitting blocks, the timing controller being further adapted to output a synchronization signal in combination with the luminance pulse signal, the synchronization signal indicating a temporal start position of the representative grayscale values that are embedded in the luminance pulse signal; and a local dimming driving part adapted to drive the light-emitting blocks using the synchronization signal and the embedded representative grayscale values of the luminance pulse signal.

11. The display apparatus of claim 10, wherein the timing controller comprises:

a representative grayscale value obtaining part adapted to obtain a red representative grayscale value, a green representative grayscale value and a blue representative grayscale value from the image;

a luminance pulse generating part adapted to generate a red luminance pulse signal, a green luminance pulse signal and a blue luminance pulse signal, respectively, corresponding to the red, green, and blue representative grayscale values and further adapted to insert the synchronization signal into one of the red, green, and blue luminance pulse signals; and an interface part adapted to transmit the luminance pulse signal comprising the red, green, and blue luminance pulse signals to the local dimming driving part.

12. The display apparatus of claim 11, wherein the local dimming driving part comprises:

an interface part adapted to receive the red, green and blue luminance pulse signals, where one of said pulse signals has the synchronization signal inserted therein;

a data processing part adapted to obtain the red, green and blue representative grayscale values from the red, green and blue luminance pulse signals, respectively;

a representative luminance value calculating part adapted to calculate representative luminance values of the light-emitting blocks using the obtained red, green and blue representative grayscale values;

a dimming level determining part adapted to determine a dimming level to control luminance of the light-emitting blocks based on the representative luminance values; and a light source driving part adapted to drive the light-emitting blocks based on the dimming level.

13. The display apparatus of claim 12, wherein the data processing part comprises:

a synchronization signal detecting part adapted to detect the synchronization signal in one of the red, green and blue luminance pulse signals;

a first counter adapted to count a number of edges of a clock signal in response to the detection of the synchronization signal; and a data obtaining part adapted to analyze the red, green and blue luminance pulse signals after a counted value of the first counter becomes a first setting value that has been preset to obtain the red, green and blue representative grayscale values.

14. The display apparatus of claim 13, wherein the light-emitting blocks are grouped into a plurality of driving blocks, the data processing part further comprises a second counter adapted to count a number of edges of the clock signal from a point in time when the red, green, and blue representative grayscale values corresponding to one of the driving blocks have been obtained, and the data obtaining part is further adapted to compare a counted value of the second counter with a second setting value that has been preset to determine a blanking interval.

15. The display apparatus of claim 12, wherein the light-emitting blocks comprise a plurality of white light-emitting diodes (LEDs).

16. The display apparatus of claim 10, wherein the timing controller comprises:

a representative luminance value calculating part adapted to obtain red, green and blue representative grayscale values from the image and further adapted to calculate a representative luminance value using the red, green, and blue representative grayscale values;

a luminance pulse generating part adapted to insert the synchronization signal into the luminance pulse signal having the representative luminance values; and an interface part adapted to transmit the luminance pulse signal to the local dimming driving part.

17. The display apparatus of claim 16, wherein the local dimming driving part comprises:

an interface part adapted to receive the luminance pulse signal;

a data processing part adapted to detect the synchronization signal inserted in the luminance pulse signal and further adapted to obtain the representative luminance value from the luminance pulse signal based on the detection of the synchronization signal;

a dimming level determining part adapted to determine dimming levels to control luminance of the light-emitting blocks based on the obtained representative luminance values; and a light source driving part adapted to drive the light-emitting blocks based on the dimming levels.

18. The display apparatus of claim 17, wherein the data processing part comprises:

a synchronization signal detecting part adapted to detect the synchronization signal inserted in the luminance pulse signal;

a counter adapted to count a number of edges of a clock signal in response to the detection of the synchronization signal; and a data obtaining part adapted to analyze the luminance pulse signal after a counted value of the counter becomes a setting value that has been preset to obtain the representative grayscale value.

19. The display apparatus of claim 18, wherein the light-emitting blocks comprise a plurality of white light-emitting diodes (LEDs).

* * * * *